US006978960B2

(12) United States Patent
Schaller

(10) Patent No.: US 6,978,960 B2
(45) Date of Patent: Dec. 27, 2005

(54) HOSE REEL WITH INTEGRAL HUB ASSEMBLY

(76) Inventor: James M. Schaller, 11727 Eagle Lake Ct., Fort Wayne, IN (US) 46814

( * ) Notice: Subject to any disclaimer, the term of this patent is extended or adjusted under 35 U.S.C. 154(b) by 0 days.

(21) Appl. No.: 10/698,720

(22) Filed: Oct. 31, 2003

(65) Prior Publication Data

US 2005/0092366 A1 May 5, 2005

(51) Int. Cl.[7] ..... B65H 75/48

(52) U.S. Cl. ..... 242/385.3; 242/376; 242/611.1; 137/355.16

(58) Field of Search ..... 242/385.3, 376, 242/377, 397.3, 407, 407.1, 611.1; 137/355.16, 137/355.21, 355.26

(56) References Cited

U.S. PATENT DOCUMENTS

| | | | | | |
|---|---|---|---|---|---|
| 700,517 | A | * | 5/1902 | White | 242/377 |
| 3,093,342 | A | * | 6/1963 | Krohn | 242/375.1 |
| 3,176,931 | A | * | 4/1965 | Hannay | 242/376.1 |
| 4,506,698 | A | | 3/1985 | Garcia et al. | |
| 4,512,361 | A | | 4/1985 | Tisbo et al. | |
| 4,768,546 | A | | 9/1988 | Brusadin et al. | |
| 4,777,976 | A | | 10/1988 | Johnston et al. | |
| 4,832,074 | A | * | 5/1989 | Li | 137/355.2 |
| 5,007,598 | A | | 4/1991 | Spear et al. | |
| 5,046,520 | A | | 9/1991 | Sanchez, Jr. et al. | |
| 5,056,553 | A | | 10/1991 | Whitehead et al. | |
| 5,381,981 | A | | 1/1995 | Nelson | |
| 5,425,391 | A | | 6/1995 | Tisbo et al. | |
| 5,657,789 | A | | 8/1997 | Tisbo et al. | |
| 5,704,384 | A | | 1/1998 | Tisbo et al. | |
| 5,758,685 | A | | 6/1998 | Tisbo et al. | |
| 5,787,923 | A | * | 8/1998 | Shea et al. | 137/355.26 |
| 5,794,649 | A | | 8/1998 | Spear et al. | |
| 5,797,424 | A | | 8/1998 | Tisbo et al. | |
| 5,934,314 | A | | 8/1999 | Spear et al. | |
| 5,975,459 | A | | 11/1999 | Roman | |
| 2004/0094204 | A1 | * | 5/2004 | Lin | 137/355.16 |

* cited by examiner

*Primary Examiner*—Kathy Matecki
*Assistant Examiner*—Sang Kim
(74) *Attorney, Agent, or Firm*—Butzel Long

(57) ABSTRACT

A hose reel that includes a spool that is formed by attaching a pair of spool flange plates to opposite sides of hub assembly. The hub assembly is an integral unitary structure that includes central hub, a plurality of spokes extending radially from the central hub, a plurality of hub sections provided at the radial ends of the plurality of spokes which define a cylindrical surface upon which a hose can be wound, an annular bracing element connected between the plurality of spokes, and a latch gear provided on the annular bracing element. The central hub includes a spring catch that is configured to engage a spring of a rewinding mechanism.

20 Claims, 8 Drawing Sheets

HOSE REEL WITH INTEGRAL HUB ASSEMBLY

TECHNICAL FIELD

The present invention relates to take-up reels of the type used for winding up and paying out various types of elongated flexible hoses and which automatically rewind the flexible hoses for storage.

BACKGROUND ART

Hose reels provide a spool onto which a length of hose may be wound and stored for the convenience of a user. In some instances, the reel is replaced by a partial spool or partial hub which may be fixed to the side of a structure, such as a house, or to a post. In these configurations, whether a reel or a partial spool or hub is used, the purpose is to provide a support for the coiled hose.

Manual hose reels require that once an activity such as watering, washing, fluid dispensing, etc. has been completed, the length of hose that was extended and unwound from the reel is then wound up back onto the reel by hand. This can be achieved by rotating the reel in the proper direction as the extended length of hose wraps itself on the hub of the reel, layer after layer. The rotation of the reel may be performed by directly moving the outer plate end of the spool or may be accomplished by the use of a hand crank that is connected to and rotates the hub of the spool.

In addition to manual reels there are kinetic take-up reels (or simply "take-up" reels) and motor driven reels. Kinetic take-up reels are typically provided with a spring mechanism that stores kinetic energy as the flexible member, e.g. hose is paid out and unwound. When the free end of the flexible member is released, the kinetic energy that is stored in the spring mechanism is used to rotate the reel in a direction that causes the flexible member to be wound back onto the reel. Kinetic take-up reels are typically provided with some type of latch mechanism that will prevent the reel from rotating and rewinding the flexible member until the latch mechanism is released.

There are numerous applications in which a flexible member such as a cable, rope, hose, electrical cord or the like is wound for storage about a take-up reel when not in use. When use of the flexible member is required, an appropriate length of the flexible member it is paid out by unwinding it from the take-up reel. A popular application for this type of mechanism is exemplified by the use of flexible hoses for conducting air, water, oil, grease, antifreeze and the like from a reservoir to a dispensing nozzle. For example, in the typical automobile service station, air is delivered from a compressor tank through a pipe to a spring-loaded take-up reel about which is stored a length of tubular air hose. When air is needed, the air hose is pulled from the reel until the desired length is paid out. When the air hose is no longer in use, the free end is released and a torsional spring acting on the hose reel rewinds the hose back onto the reel.

Portable hose reels are very popular with home owners and particularly gardeners. In portable hose reels the reel is carried by a hand cart or wheeled frame, which can be constructed of a tubular metal or take the form of a molded plastic frame. The purpose of the hand cart, which is normally provided with a pair of wheels, is to enable the length of hose that is disposed on the reel to be moved about the yard or garden area more conveniently. In these arrangements, one end of the hose is connected to a faucet and the other end of the hose remains free while the length of hose in between the two ends is wound onto the reel.

Commercial reels require a number of intricate parts including elements of the basic reel and support structures, the fluid plumbing elements, and rewinding mechanisms. The combination of these various elements and their assembly adds to the overall costs of manufacturing hole reels and increases the possibility of mechanical failure and fluid leakage.

The present invention provides a hose reel that has significantly fewer parts and which can be more easily assembled that present hose reels.

DISCLOSURE OF THE INVENTION

According to various features, characteristics and embodiments of the present invention which will become apparent as the description thereof proceeds, the present invention provides a hose reel which comprises:

a spool for receiving a length of hose thereon;

a mounting bracket;

a fluid inlet tube having a central axis and coupling the spool to the mounting bracket so that the spool can rotate about the central axis of the fluid inlet tube with respect to the mounting bracket; and a mechanical rewinding mechanism coupled to the spool, the spool including a hub assembly and a pair of spool flange plates attached to opposite sides of the hub assembly, the hub assembly comprising, as an integral element thereof, a latch gear having a plurality of teeth that cooperate with a rewinding latch mechanism.

The present invention further provides a hub assembly for a hose reel which comprises, as an integral unit:

a central hub;

a plurality of spokes extending radially from the central hub;

a plurality of hub sections provided at the radial ends of the plurality of spokes which define a cylindrical surface upon which a hose can be wound;

an annular bracing element connected between the plurality of spokes; and a latch gear provided on the annular bracing element.

The present invention further provides a method of forming a spool for a hose reel which comprises:

a) providing a hub assembly that comprises an integral unitary structure that includes:

a central hub;

a plurality of spokes extending radially from the central hub;

a plurality of hub sections provided at the radial ends of the plurality of spokes which define a cylindrical surface upon which a hose can be wound; and a latch gear;

b) providing a pair of spool flange plates; and c) attaching the pair of spool flange plates to opposite sides of the hub assembly.

BRIEF DESCRIPTION OF DRAWINGS

The present invention will be described with reference to the attached drawings which are given as non-limiting examples only, in which.

BEST MODE FOR CARRYING OUT THE INVENTION

Figure 1:
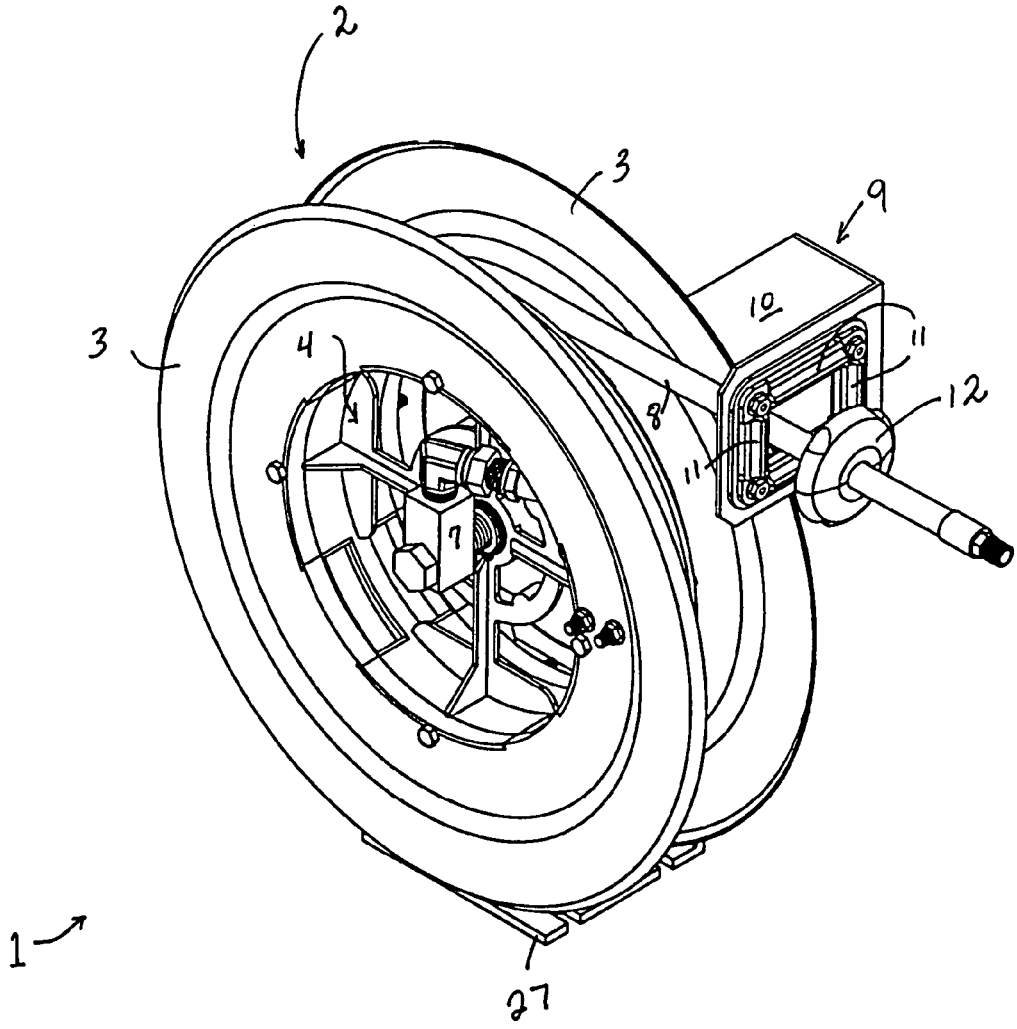
FIG. 1 is a perspective view of a hose reel according to one embodiment of the present invention.

The present invention is directed to hose reels of the type used for winding up and paying out various types of elongated flexible hoses. The hose reels of the present invention include mechanical rewinding mechanisms that cause a length of flexible hose unwound from the hose reels to rewind back onto the hose reels when actuated.

The hose reels of the present invention include a hub assembly that comprises, as an integral unit, a central hub, a plurality of spokes extending radially from the central hub, reel hub sections supported by the plurality of spokes, a latch gear and a spring catch. The hub assembly is designed and configured to be molded or cast as an integral unit so as to reduce the number of individual elements of the hose reel and to reduce assembly cost. Moreover, the spool flange plates which are discussed in more detail below can be economically fabricated for use in conjunction with the hub assembly design. The spool of the hose reel comprises the hub assembly and opposed spool flange plates which are fastened together on opposite sides of the hub assembly.

The mechanical rewinding mechanism used in conjunction with the hose reels of the present invention includes a spring housing containing a spiral spring. An outer end of the spiral spring is held in a fixed position with respect to the spring housing and an inner end of the spiral spring is configured to engage the spring catch on the hub assembly when the hub assembly is rotated in a direction to unwind a length of hose on the hose reel.

The spring housing is held in a fixed position when the hose reel is mounted to a support. The spool, i.e. the hub assembly and spool flange plates, rotate with respect to the spring housing. The support for the hose reel can include a mounting bracket that is configured to clear the spool so as not to interfere with the rotation of the spool or a hose being unwound or wound thereon. The mounting bracket can otherwise have any desired configuration required to mount the hose reel on a post, wall, beam, or any other support structure. The hose reels of the present invention include a fluid inlet tube that serves an axis of rotation for the spool, i.e. the hub assembly and spool flange plates. An end of the fluid inlet tube that extends though the hub assembly is connected to a swivel hose fitting that allows a hose to be coupled thereto and extend radially from the end of the fluid inlet tube so that the hose can be wound around the hub reel sections of the hose reel. The hose reels of the present invention can also be provided with hose guides that ensure that a length of hose that is unwound or wound on the reels is guided off and on in such a manner that the hose does not become tangled on the reel. The hose guides can include through-openings which are framed by rollers which reduce friction when a hose is passed though the hose guides. The hose guides are configured so that the through-openings thereof are positioned over a central portion of the hose reel spools.

FIG. 1 is a perspective view of a hose reel according to one embodiment of the present invention. The hose reel 1 generally includes a spool 2 which is formed by fixing opposed spool flange plates 3 together on opposite sides of an integral hub assembly 4. The spool 2 is supported on a fluid inlet tube 5 which extends through a central axis of the spool 2. One end of the fluid inlet tube 5 is supported by mounting bracket 6 that is configured to mount the hose reel 1 on a support such as a post, wall, beam or other sturdy structure. A swivel hose fitting 7 is attached to the non-supported end of the fluid inlet tube 5 and used to couple a hose 8 thereto as depicted. In the embodiment of the invention depicted in FIG. 1 a single hose 8 is coupled. to the swivel hose fitting 7. In further embodiments of the present invention that are directed to uses such as acetylene torches, the swivel hose fitting 7 can be a dual hose fitting. The use of a swivel hose fitting 7 allows the end of the hose 8 coupled thereto to rotate with the spool 2 while being supplied with a fluid through the fluid inlet tube 5.

The hose reel depicted in FIG. 1 includes a hose guide 9 which includes a support arm 10 and a through-opening that is framed by rollers 11. The hose 8 provided on the hose reel 1 in FIG. 1 has a hose stop 12 attached at a short distance from the free end of the hose 8. The hose stop 12 comprises two half portions which are clamped around the hose 8 and secured together by suitable threaded fasteners. The hose stop 12 prevents the free end of the hose 8 from becoming wound on the spool 2. The short length of the hose 8 that extends from the hose stop 12 can be grasped and used to pull and unwind the hose 8 from the hose reel 1.

As can be seen in FIG. 1 the spool flange plates 3 include central openings through which the back side of the hub assembly 4 can be seen. The structure of the hub assembly 4 is more clearly seen in FIG. 2.

Figure 2:
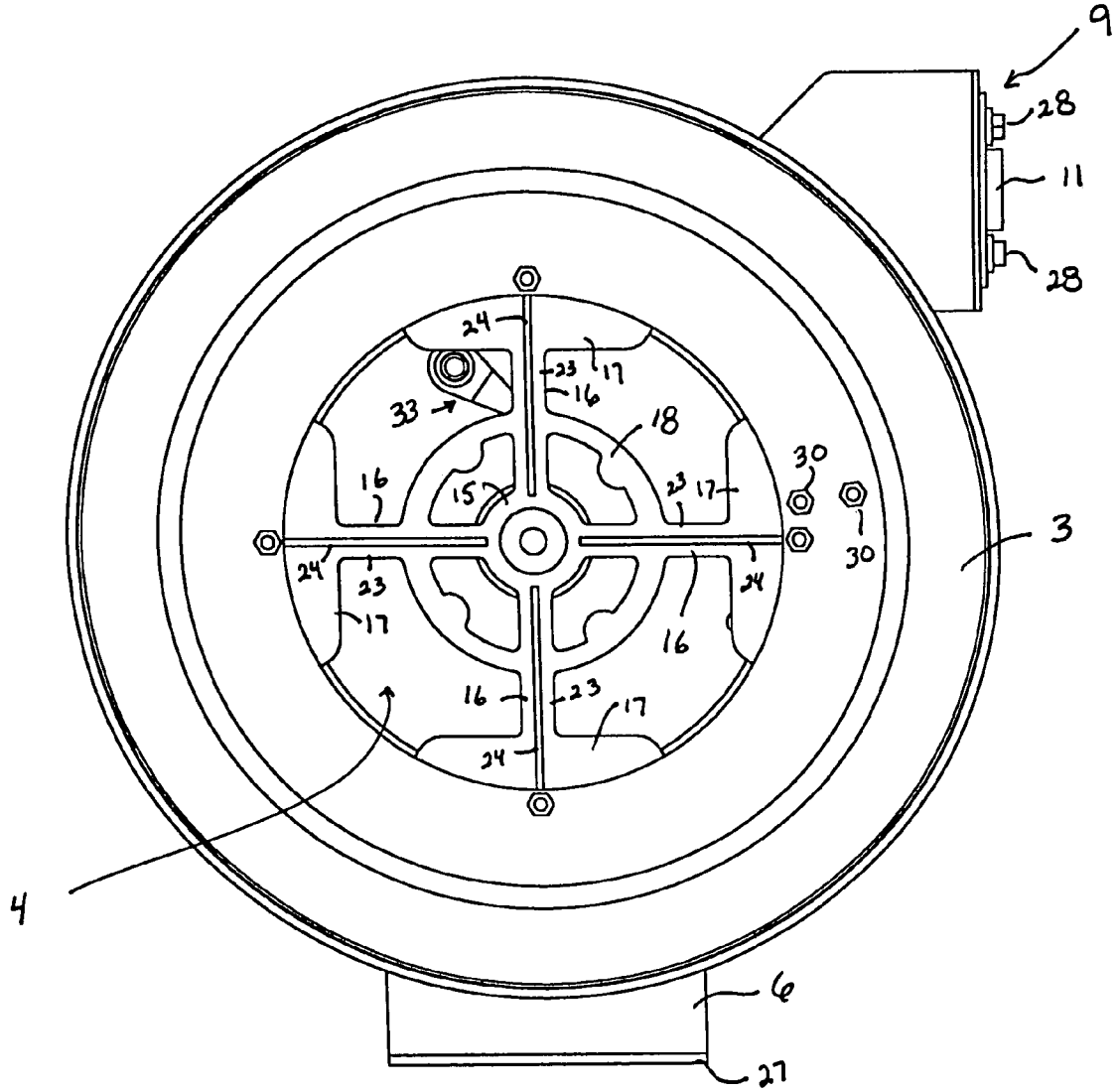
FIG. 2 is a planar side view of the hose reel of FIG. 1 which shows the back side of the hub assembly.

FIG. 2 is a planar side view of the hose reel of FIG. 1 which shows the back side of the hub assembly. As can be seen in FIG. 2, the hub assembly 4 includes a central hub 15, a plurality of spokes 16 extending radially from the central hub 15, reel hub sections 17 supported by the plurality of spokes 16, and an annular bracing structure 18 all of which can be seen from the back view of the hub assembly 4. The hub assembly 4 further includes a latch gear 20 and a spring catch 21 which are visible from the front of the hub assembly 4. The central hub 15 of the hub assembly 4 includes a through-bore through which the fluid inlet tube 5 extends. The spokes 16 which extend radially outward from the central hub 15 include circumferential and axial bracing webs 23, 24 that add strength to the spokes 16 for supporting reel hub sections 17. Additional structural support is provided by annular bracing structure 18 which also serves as the base for latch gear 20. In FIG. 2, hex nuts 25 indicate where threaded fasteners 26 (see FIG. 8) pass through spool flange plates 3 to secure the spool flange plates 3 to opposite sides of the hub assembly 4. The base 27 of the mounting bracket 6 is shown in FIG. 2 together with the hose guide 9.

Bolt heads 28 shown on the hose guide 9 indicate the manner in which rollers 11 are secured to frame in the through-opening in the hose guide 9.

The pair of hex nuts 30 that are aligned radially in the outer spool flange plate 3 indicate where a U-bolt 31 (see FIG. 8) or similar securing means is provided to secure an end of a hose 8 mounted on the hose reel 1 to the inner surface of the outer spool flange plate 3.

A spring biased latch pawl 33 is partially visible in FIG. 2. Latch pawl 33 cooperates with the latch gear 20 as discussed in detail below.

Figure 3:
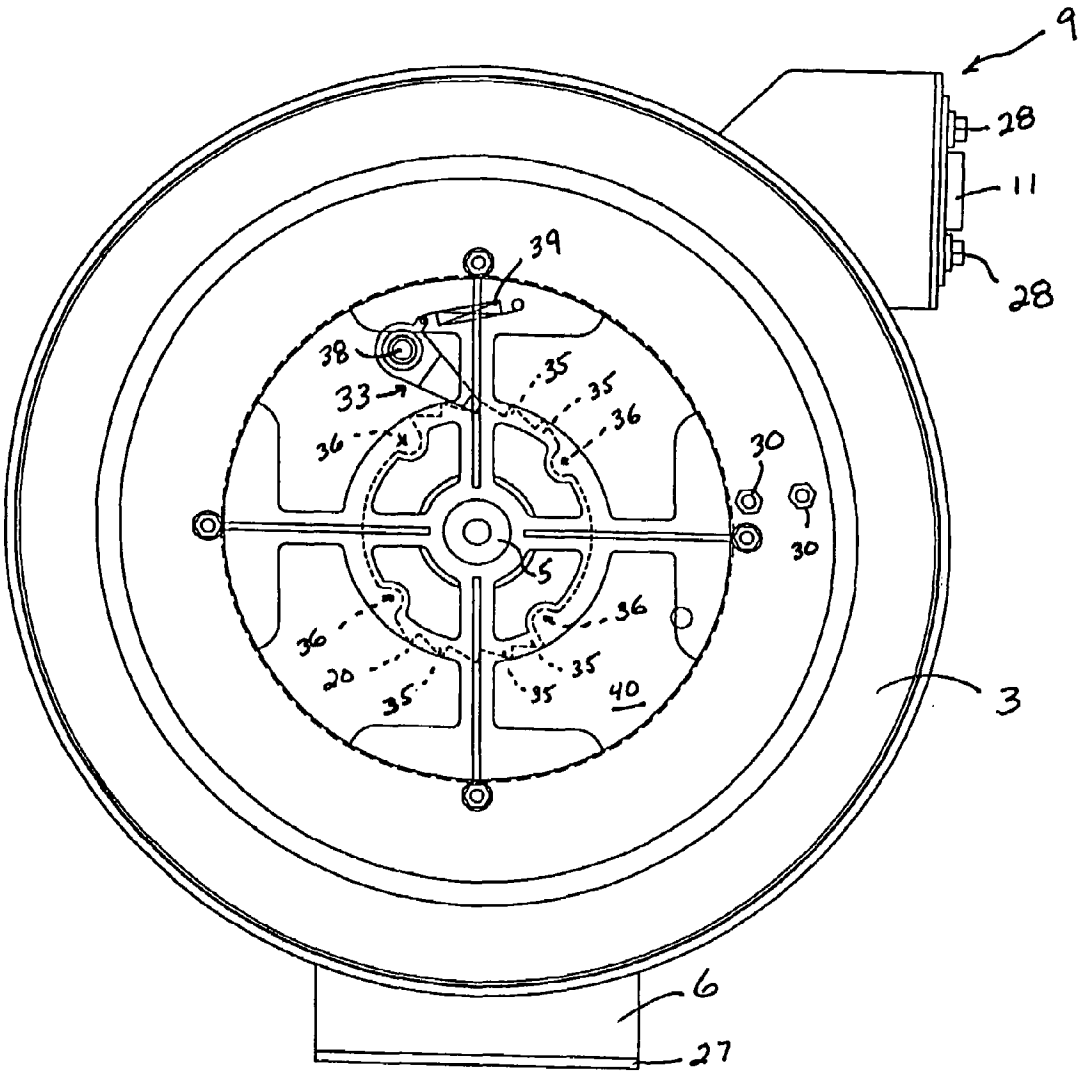
FIG. 3 is a planar side view of the hose reel of FIG. 1 which shows the front side of the hub assembly.

FIG. 3 is a planar side view of the hose reel of FIG. 1 which shows the hidden front side of the hub assembly. FIG. 3 shows the configuration of the latch gear 20 according to one embodiment of the present invention. The latch gear 20 includes a series of teeth 35 that are configured to engage latch pawl 33 as discussed in more detail below. There are two segments of teeth which are circumferentially opposed from one another. In further embodiments of the present invention there could be more or fewer than two segments of teeth. Each segment or series of teeth 35 are preceded and followed by curved recessed portions 36 which are discussed in more detail below. The latch pawl 33 is pivotal about a pivot pin 38 that is provided on the inner portion of the spring housing 40. The latch pawl 33 is biased by means of a spring element 39. The spring element 39 can be a coiled spring element having an end that is coupled to the latch pawl 33, a spring element that loops around the pivot axis of the latch pawl 33, or any other equivalent spring biasing means.

Figure 4:
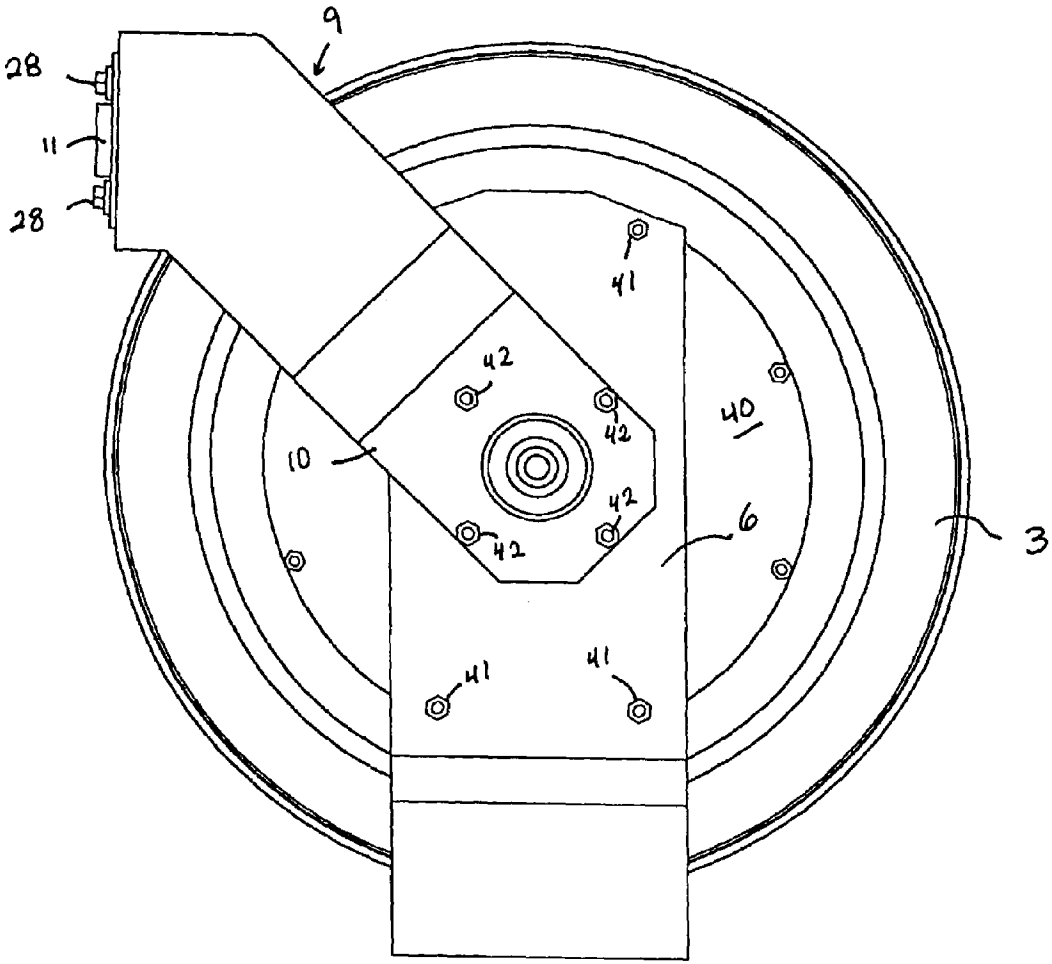
FIG. 4 is a planar side view of the hose reel of FIG. 1 which shows the mounting bracket and hose guide support.

FIG. 4 is a planar side view of the hose reel of FIG. 1 which shows the mounting bracket and hose guide support. The mounting bracket 6 depicted in FIG. 4 is secured to the spring housing 40 by mechanical fasteners 41. The support arm 10 of the hose guide 9 is secured to the mounting bracket 6 by four mechanical fasteners 42 which are provided in a square pattern. The use of a square pattern for the holes which receive mechanical fasteners 42 enables the hose guide 9 to be mounted in different locations with respect to the base 27 of the mounting bracket 6. This ability to change the location or orientation of the hose guide 9 allows the hose reel 1 to be mounted in different orientations, depending on the particular structural support available in a given location. For example if the hose reel in FIG. 4 were to be mounted in the orientation depicted in FIG. 4, the hose 8 could be easily unwound and wound using the hose guide 9 orientation depicted. If, for example, the hose reel 1 in FIG. 4 were to be mounted upside down on an overhead support, it would be better to rotate the support arm 10 of the hose guide 9 one increment clockwise in FIG. 4 so that the next alignment of the through-holes for mechanical fasteners 42 align the through-opening 44 of the hose guide 9 downward.

Figure 5:
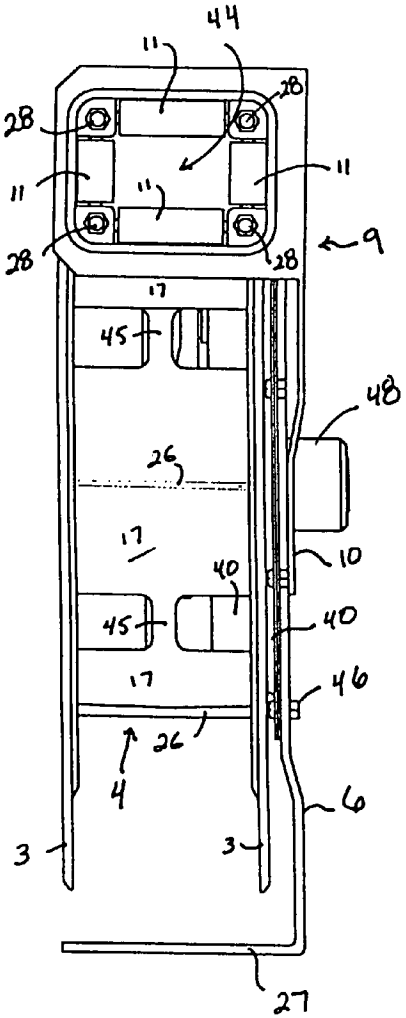
FIG. 5 is a planar front view of the hose reel of FIG. 1.

FIG. 5 is a planar front view of the hose reel of FIG. 1. As shown in FIG. 5, the adjacent reel hub sections 17 are connected together by web structures 45 for structural support. The threaded fasteners 26 which secure the spool flange plates 3 to opposite side of the hub assembly 4 preferably are aligned with central portions of the reel hub sections 17 for structural purposes. The heads or the threaded fasteners 26 and nuts used in conjunction therewith are not visible in FIG. 5, because the spool flange plates 3 have recessed center areas.

The mounting bracket 6 is mounted to a spring housing 40 by a plurality of mechanical fasteners 46. The spring housing 40 has a cylindrical shape and extends into the inner side of the hub assembly 4 as indicted. The support arm 10 for the hose guide 9 is fastened to the outer surface of the mounting bracket 6 by suitable mechanical fasteners, including screws, bolts, etc.

The through-opening 44 in the hose guide 9 is shown as being framed in by opposed pairs of rollers 11 that are fastened to the hose guide 9 by mechanical fasteners 28. The rollers 11 can be provided in a separate carriage which can be mechanically fastened to the hose guide 9 as desired.

A collar 48 that supports fluid inlet tube 5 and is configured, e.g. in internally threaded on the distal end, to be coupled to a fluid supply line is shown as extending though both the mounting bracket 6 and the support arm 10 of the hose guide 9. In practice it is sufficient for the collar 48 to secure the fluid inlet tube 5 to the mounting bracket 6.

Figure 6:
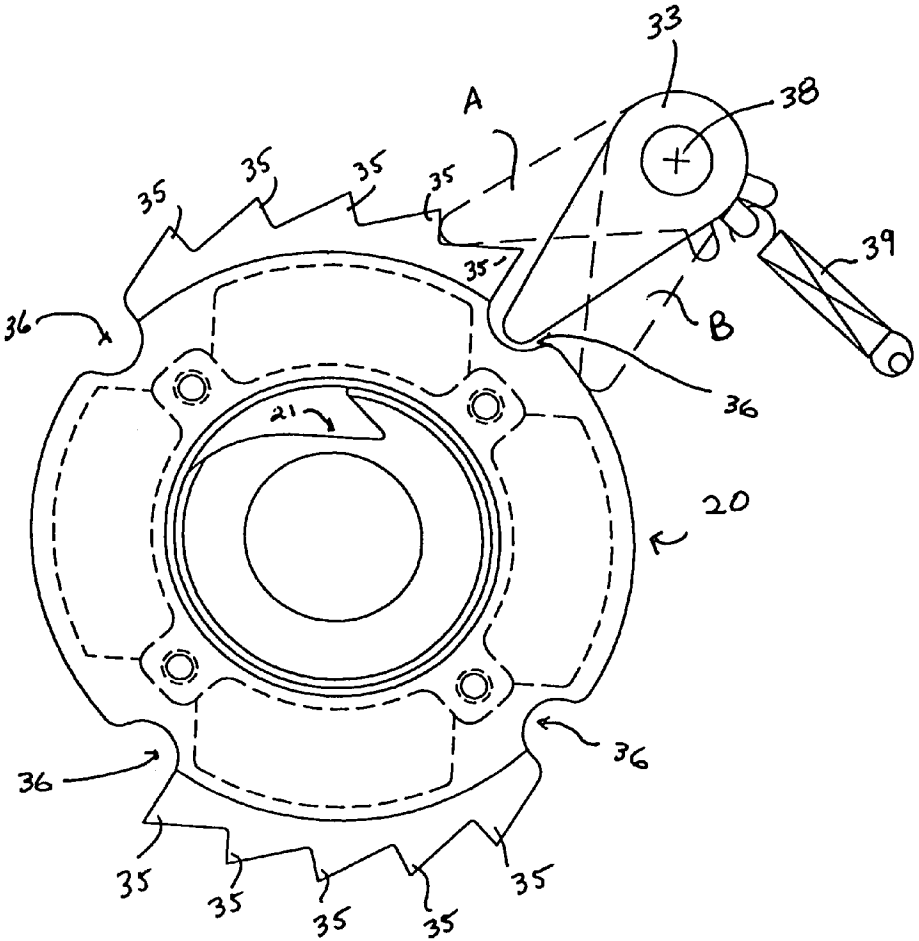
FIG. 6 is an isolated view of a portion of the hub assembly which shows the manner in which the latch pawl and the latch gear cooperate to latch and release the spool.

FIG. 6 is an isolated view of a portion of the hub assembly which shows the manner in which the latch pawl and the latch gear cooperate to latch and release the spool. The spring catch 21 comprises a notch that is formed in the central hub 15 of the hub assembly 4. As is clear from the configuration of the spring catch 21 in FIG. 6, the spring force acting on the hub assembly 4 (and spool 2) would be in the clockwise direction in FIG. 6 and a hose 8 on the hose reel 1 would be pulled off the spool 2 of the hose reel 1 in a manner that would rotate the hub assembly 4 in the counter clockwise direction in FIG. 6.

In FIG. 6 the position of the latch pawl 33 drawn in phantom and identified by arrow "A" depicts the latch pawl 33 in a position in which it would prevent the hub assembly 4 from rotating in the clockwise direction (from rewinding the hose 8), as can be seen from the fact that the force applied to the tip of the latch pawl 33 would be directed to the fixed pivot pin 38.

When the hub assembly 4 is rotated counter clockwise (by pulling hose 8) slightly from the position depicted in FIG. 6 phantom position "A", the tip of the latch pawl 33 drops into recessed area 36 under the biasing force of spring element 39. The recessed area 36 is configured to provide enough clearance for the latch pawl 33 to rotate counter clockwise in FIG. 6 and so that it moves into the position depicted in FIG. 6 phantom position "B". In this position rotation of the hub assembly 4 under the force of spring element 50 is not interrupted by latch pawl 33. At any point in which counter clockwise rotation of the hub assembly 4 (and spool 2) is stopped with the tip of the latch pawl 33 between adjacent teeth 35 of the latch gear 20, subsequent release and clockwise rotation caused by spring element 50 will cause the latch pawl 33 to arrest clockwise rotational movement of the hub assembly 4 (and spool 2).

Figures 7, 8:
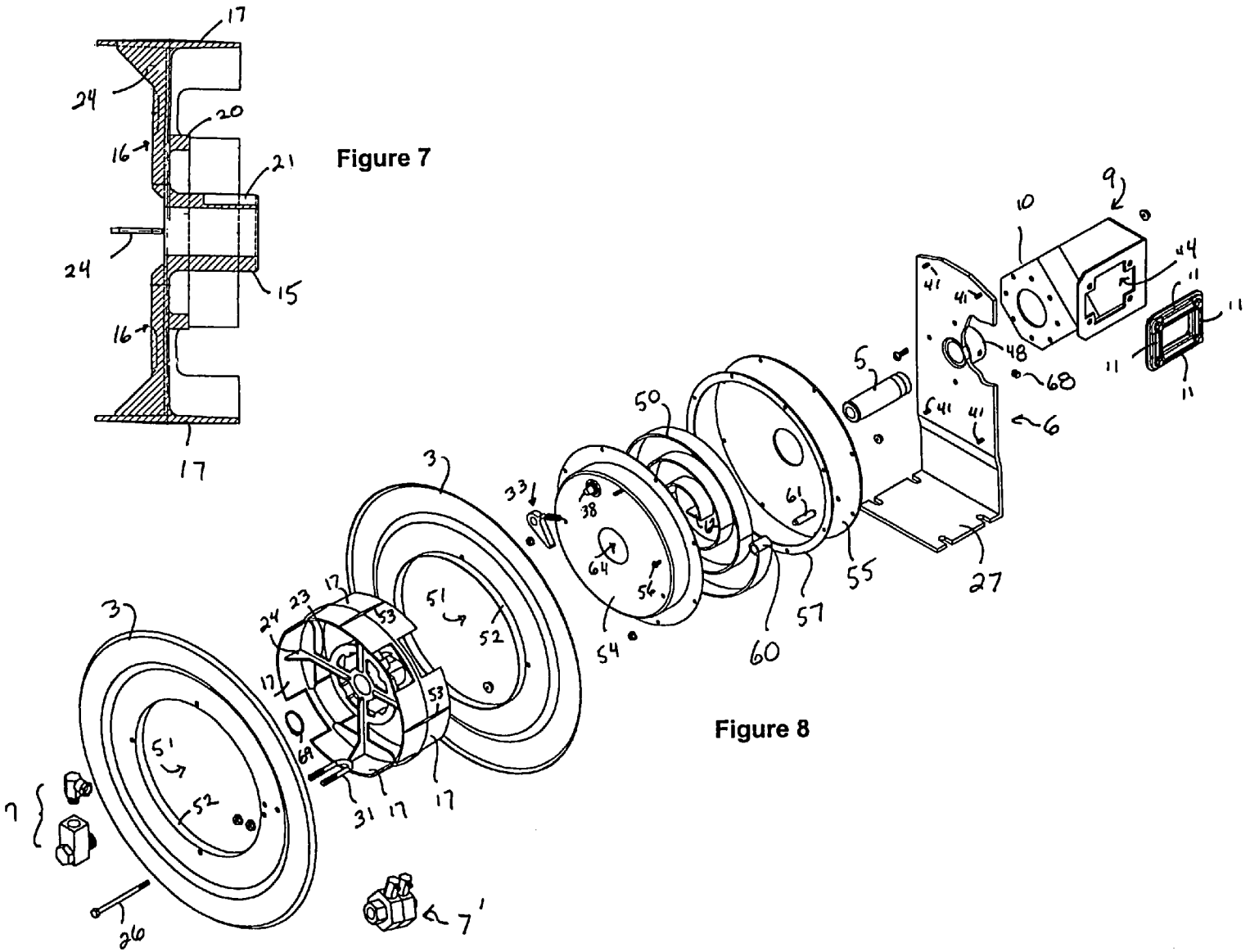
FIG. 7 is a cross-sectional view of the hub assembly according to one embodiment of the present invention.
FIG. 8 is a perspective exploded view of a hose reel according to one embodiment of the present invention.

FIG. 7 is a cross-sectional view of the hub assembly according to one embodiment of the present invention. As seen in FIG. 7, the spokes 16 are provided with axial ribs or bracing webs 23, 24 that only extend on one side of the hub assembly 4. The opposite sides of the spokes 16 do not include axial ribs or bracing webs and accordingly there is more clearance on the opposite side of the hub assembly 4 to receive the spring housing 40. The central hub 15 having the spring catch 21 therein extends axially from the center of the hub assembly 4 so that when the spring housing 40 is positioned within the recessed side of the hub assembly 4, the central hub 15 extends into the spring housing 40 an the inner end the spring element 50 can engage spring catch 21 when the hub assembly 4 is rotated in a direction that causes hose 8 on the hose reel 1 to unwind.

FIG. 8 is a perspective exploded view of a hose reel according to one embodiment of the present invention. The spool 2 of the hose reel includes hub assembly 4 and opposed spool flange plates 3 which are secured to the hub assembly 4 on opposite sides thereof. The spool flange plates 3 include central openings 51 and inward directed flanges 52 that are sized and configured to fix radially inside the reel hub sections 17 of the reel hub assembly 4. According to one embodiment, the spool flange plates 3 are secured to the hub assembly 4 by a plurality of threaded fasteners 26 (one shown) that pass through holes that are provided in the spool flange plates 3 and spaced apart circumferentially. In the embodiment of the invention that is depicted in FIG. 8 the reel hub sections 17 are provided with grooved or notched portions 53 through which the threaded fasteners 26 pass. The spring housing 40 includes a pan-shaped housing portion 54 and a cover 55 which can be secured to the pan-shaped housing portion 54 by mechanical fasteners 56 (one shown) portioned along the periphery of the spring housing 40. A gasket or seal element 57 can be provided between the pan-shaped portion 54 and cover 55 of the spring housing 40 to keep fluids and dirt out. A spiral spring element 50 is positioned within the spring housing 40 and includes an outer looped end 60 that is received on pin 61 attached and held thereto. Pin 61 can be attached to either the pan-shaped portion 54 or cover 55 of the spring housing 40 or, as shown in FIG. 8, can comprise a member that is fixed on opposite ends to both the pan-shaped portion 54 and cover 55 of the spring housing 40. The central end 62 of the spiral spring element 50 includes a flat portion that is bent inward and configured to engage spring catch 21 formed in the central hub 15 of the hub assembly 4. The pivot pin 38 of the latch pawl 33 that is provided on the inner portion of the spring housing 40 as shown.

The pan-shaped portion 54 of spring housing 40 includes a central opening 64 that is configured to receive the central hub 15 of the hub assembly 4 so that the inner end of spiral spring element 50 can engage the spring catch 21 formed in the central hub 15 of the hub assembly 4.

Mounting bracket 6 is fastened to the spring housing 40 by mechanical fasteners 41 which can also be used to secure the pan-shaped portion 54 and cover 55 of the spring housing 40 together. The mounting bracket 6 is configured to provide clearance at the side of the spool 2 and a base 27 which, as indicated above, can be configured to be mounted to any convenient support.

The hose guide support arm 10 is attached to the mounting bracket 6 by mechanical fasteners 42. The hose guide 9 includes through-opening 44 which is surrounded or framed by a plurality of rollers 11 which can be provided in a roller carriage 66 that can be fastened to the hose guide 9 by mechanical fasteners 28 or other suitable means.

Fluid inlet tube 5 is supported by mounting bracket 6 by a collar 48 that is configured, e.g. internally threaded or provided with a fitting, to be coupled to a fluid supply source such as a fluid supply line. A swivel hose fitting 7 is attached to the non-supported end of the fluid inlet tube 5 and used to couple a hose 8 thereto. Both a single hose swivel fitting 7 and a dual hose swivel fitting 7' are illustrated. According to another embodiment of the present invention, a base for the hose swivel fitting could be cast as an integral part of the hub assembly 4 and thereafter machined to enable coupling of a hose thereto.

As indicated in FIG. 8, the supported end of the fluid inlet tube 5 can be secured in collar 48 by a set screw 68. The non-supported end of the fluid inlet tube 5 can be configured to receive a retaining member 69, e.g. snap ring, which can be attached after the non-supported end of the fluid inlet tube 5 is passed through the hub assembly 4.

FIG. 8 depicts a U-bolt 31 that is used to secure an end of a hose 8 mounted on the hose reel 1 to the inner surface of the outer spool flange plate 3.

Figure 9B:
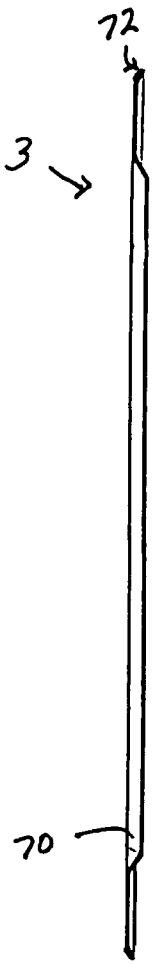
FIG. 9*b* is a cross-sectional view of the spool flange plate of FIG. 9*a*.
Figure 9A:
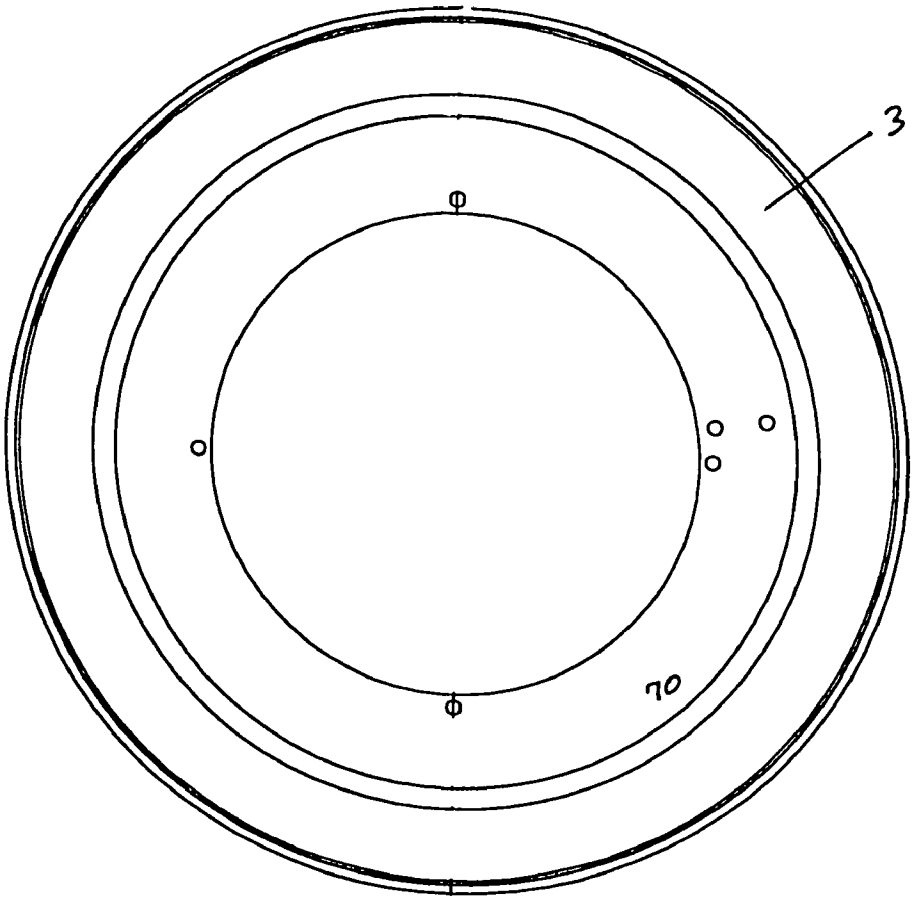
FIG. 9*a* is a planar side view of a spool flange plate according to one embodiment of the present invention.

FIG. 9*a* is a planar side view of a spool flange plate according to one embodiment of the present invention. FIG. 9*b* is a cross-sectional view of the spool flange plate of FIG. 9*a*. As shown in FIGS. 9*a* and 9*b*, the spool flange plate 3 includes a recessed central portion 70 and an inward directed outer edge 72 that can be bent over outward in a reversed manner to provide additional strength and avoid a sharp edge. The spool flange plate 3 depicted in FIGS. 9*a* and 9*b* can be made from a sturdy metal such as steel, stainless steel, etc. that can be machined and/or pressed into shape. The holes for fasteners 26 and U-bolt 31 are shown. It is noted that the spool flange plates 3 used on either side of the hub assembly 4 can be identical. Accordingly, although the holes for U-bolt 31 are only needed in the outer spool flange plate 3 (furthest from mounting bracket 6), such holes can be provided in both spool flange plates 3.

Figure 10B:
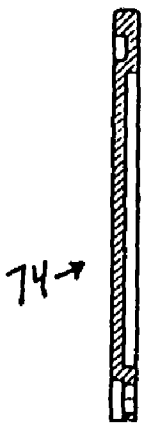
FIG. 10*b* is a cross-sectional view of the spool flange plate of FIG. 10*a* taken along sectional lines A—A.
Figure 10A:
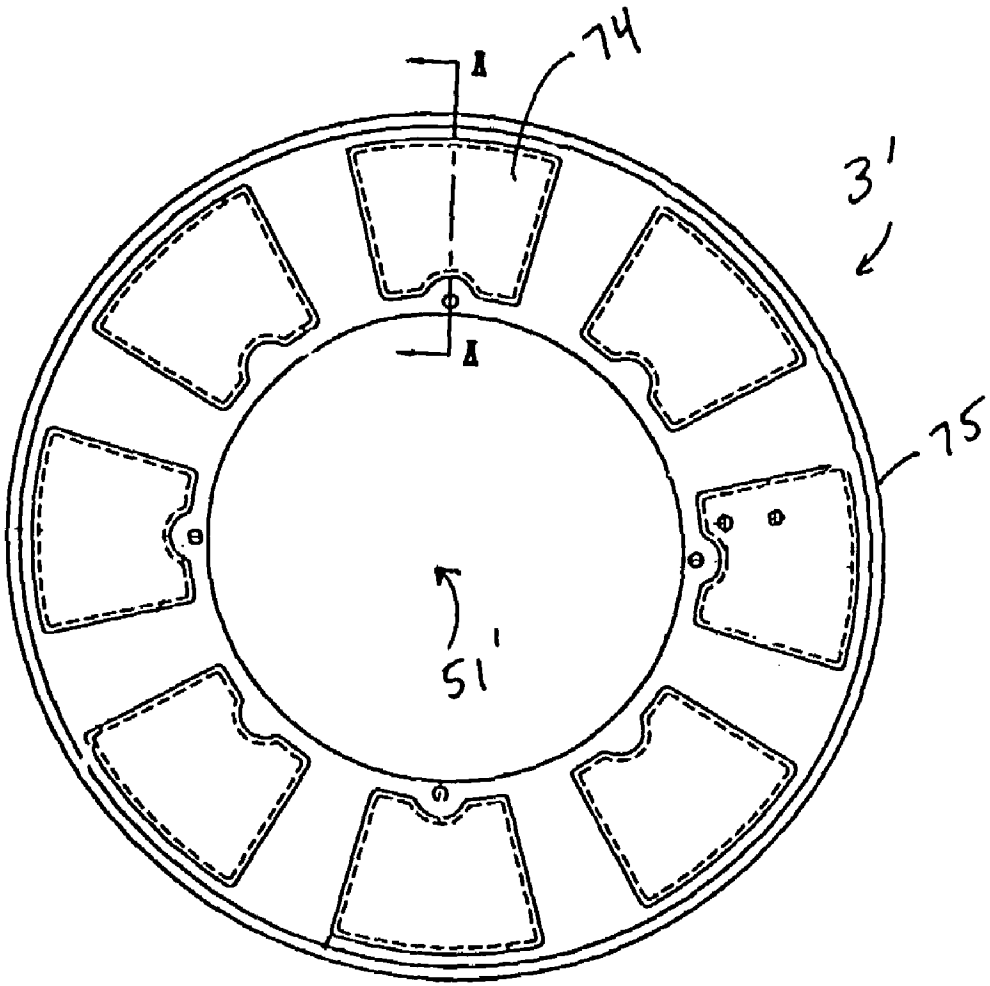
FIG. 10*a* is a planar side view of a spool flange plate according to another embodiment of the present invention.

FIG. 10*a* is a planar side view of a spool flange plate according to another embodiment of the present invention. FIG. 10*b* is a cross-sectional view of the spool flange plate of FIG. 10*a* taken along sectional lines A—A. FIGS. 10*a* and 10*b* depict an embodiment in which the spool flange plate 3' is formed, e.g. molded, from a plastic, polymeric or resinous material.

The spool flange plate 3' can have a substantially flat or planar cross-section or, as shown in FIG. 10*b*, can include raised or contoured sections 74 that are circumferentially spaced apart and provided between the central opening 51' and peripheral edge 75 of the spool flange plate 3' for both increased structural strength and visual design purposes.

The various elements of the hose reel of the present invention are preferably made of a relatively strong and resilient material such as steel, stainless steel, aluminum alloys, or other metal, plastic, fiberglass, composites, or combinations thereof. The hub assembly can be cast from aluminum, brass, and other metal alloys that will not corrode when exposed to the fluid to be dispensed by the hose reel.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above.

What is claimed is:

1. A hose reel which comprises:

a spool for receiving a length of hose thereon;

a mounting bracket;

a fluid inlet tube having a central axis and coupling the spool to the mounting bracket so that the spool can rotate about the central axis of the fluid inlet tube with respect to the mounting bracket; and a mechanical rewinding mechanism coupled to the spool, the spool including a hub assembly and a pair of spool flange plates attached to opposite sides of the hub assembly, the hub assembly comprising a one-piece, cast or molded unitary structure that includes:

a latch gear having a plurality of teeth that cooperate with a rewinding latch mechanism, and a substantially cylindrical surface upon which a hose can be wound.

2. A hose reel according to claim 1, wherein the one-piece cast or molded hub assembly further comprises an annular bracing structure upon which the latch gear assembly is supported.

3. A hose reel according to claim 1, wherein the one-piece cast or molded hub assembly further comprises a plurality of radial spokes which support hub sections of the hub assembly.

4. A hose reel according to claim 3, wherein the hub sections are spaced apart circumferentially and connected together by circumferentially extending web structures.

5. A hose reel according to claim 1, wherein the mechanical rewinding mechanism includes a spring housing containing a spiral spring and the hose reel includes a spring biased pawl which is pivotally coupled to the spring housing and positioned to cooperate with latch gear.

6. A hose reel according to claim 5, wherein the one-piece cast or molded hub assembly further includes a central hub that includes a spring catch and the spiral spring has an inner end that is configured to engage the spring catch.

7. A hose reel according to claim 1, wherein the mechanical rewinding mechanism includes a spring housing and the mounting bracket is coupled to the spring housing.

8. A hose reel according to claim 1, further including a hose guide that is coupled to the mounting bracket and includes a through-opening that is framed by plurality of rollers.

9. A hose reel according to claim 1, wherein the spool flange plates are attached to opposite sides of the hub assembly by a plurality of mechanical fasteners which extend through each of the spool flange plates with the hub assembly positioned therebetween.

10. A one-piece cast or molded hub assembly for a hose reel which comprises, as a single unitary structure:

a central hub;

a plurality of spokes extending radially from the central hub;

a plurality of hub sections provided at the radial ends of the plurality of spokes which define a cylindrical surface upon which a hose can be wound;

an annular bracing element connected between the plurality of spokes and radially inward of the hub sections; and a latch gear provided on the annular bracing element.

11. A one-piece cast or molded hub assembly for a hose reel according to claim 10, wherein the plurality of hub sections are spaced apart circumferentially and connected together by circumferentially extending web structures.

12. A one-piece cast or molded hub assembly for a hose reel according to claim 10, wherein the plurality of spokes are aligned with axially centers of the plurality of hub sections and the annual bracing element, latch gear and central hub all extend from a common axial side of the plurality of spokes.

13. A one-piece cast or molded hub assembly for a hose reel according to claim 10, wherein the plurality of spokes each have circumferentially and axially extending bracing support structures.

14. A one-piece cast or molded hub assembly for a hose reel according to claim 10, wherein the central hub includes a spring catch.

15. A one-piece cast or molded hub assembly for a hose reel according to claim 10, wherein the latch gear includes a plurality of outward projecting teeth.

16. A one-piece cast or molded hub assembly for a hose reel according to claim 15, wherein the outward projecting teeth are arranged in at least one segment that includes a group of teeth that are preceded and followed by a recess.

17. A one-piece cast or molded hub assembly for a hose reel according to claim 10, wherein the hub assembly comprises an integrally cast unitary structure.

18. A method of forming a spool for a hose reel which comprises:

a) providing a one-piece cast or molded hub assembly that comprises as a single unitary structure:

a central hub;

a plurality of spokes extending radially from the central hub;

a plurality of hub sections provided at the radial ends of the plurality of spokes which define a cylindrical surface upon which a hose can be wound; and a latch gear;

b) providing a pair of spool flange plates; and c) attaching the pair of spool flange plates to opposite sides of the one-piece cast or molded hub assembly.

19. A method of forming a spool for a hose reel according to claim 18, wherein the step of attaching the pair of spool flange plate to opposite sides of the one-piece cast or molded hub assembly comprises coupling the spool flange plates together with a plurality of mechanical fasteners with the one-piece cast or molded hub assembly positioned between the pair of spool flange plates.

20. A method of forming a spool for a hose reel according to claim 18, which comprises further providing the one-piece cast or molded hub assembly with a spring catch in the central hub of the one-piece cast or molded hub assembly.

* * * * *